US006810893B1

(12) United States Patent
Nevin

(10) Patent No.: US 6,810,893 B1
(45) Date of Patent: Nov. 2, 2004

(54) UMBRELLA MECHANISM

(75) Inventor: Michael Patrick Nevin, Constantia (ZA)

(73) Assignee: Powerbrella Clare Corporation, Cape Town (ZA)

( * ) Notice: Subject to any disclaimer, the term of this patent is extended or adjusted under 35 U.S.C. 154(b) by 12 days.

(21) Appl. No.: 10/148,024

(22) PCT Filed: Nov. 8, 2000

(86) PCT No.: PCT/IB00/01623

§ 371 (c)(1),
(2), (4) Date: Aug. 26, 2002

(87) PCT Pub. No.: WO01/35786

PCT Pub. Date: May 25, 2001

(30) Foreign Application Priority Data

Nov. 17, 2000 (ZA) ..... 99/7165

(51) Int. Cl.[7] ..... D45D 25/14
(52) U.S. Cl. ..... 135/22
(58) Field of Search ..... 135/22, 24, 20.3

(56) References Cited

U.S. PATENT DOCUMENTS

| | | | | |
|---|---|---|---|---|
| 3,765,433 A | | 10/1973 | Futamura et al. | |
| 4,807,655 A | * | 2/1989 | Robertson | 135/22 |
| 5,144,970 A | * | 9/1992 | Seidel et al. | 135/22 |
| 5,318,067 A | * | 6/1994 | Day | 135/22 |
| 5,564,449 A | * | 10/1996 | Lin et al. | 135/24 |
| 5,640,984 A | * | 6/1997 | Dubunsky | 135/33.2 |
| 5,711,333 A | * | 1/1998 | Vanderminden, Sr. | 135/20.3 |
| 5,740,822 A | * | 4/1998 | Einck | 135/16 |
| 6,070,602 A | * | 6/2000 | Ling Kuo | 135/25.4 |

FOREIGN PATENT DOCUMENTS

| | | | |
|---|---|---|---|
| DE | 28 03 857 A | | 8/1979 |
| DE | 35 09 120 A | | 9/1986 |
| DE | 296 05 659 U | | 7/1996 |
| DE | 297 00 306 | | 4/1997 |
| DE | 102 37 991 | * | 7/2003 |
| EP | 0 200 571 | | 5/1986 |
| EP | 0 829 598 A1 | | 3/1998 |

* cited by examiner

*Primary Examiner*—Janet M. Wilkens
(74) *Attorney, Agent, or Firm*—Skinner and Associates

(57) ABSTRACT

An umbrella mechanism (10) comprises a central post (12), eight ribs (14) that are pivotally connected to the post, a sliding hub (16) that is slideably retained on the post, eight struts (18) that each extend between a particular rib (14) and the sliding hub (16), eight tensioning cords (20) and a gas spring (22) that is disposed at an upper end of the central post for exerting a pulling force on the tensioning cords. The ribs are pivotally displaceable between a collapsed condition wherein the ribs (14) are disposed adjacent the post (12) and an open condition wherein the ribs extend radially from the central post. Each tensioning cord is connected at one end to an upper end of the gas spring and at the other end, to a distal end of a particular rib. The gas spring exerts a pulling force on the tensioning cords for assisting in lifting the ribs.

11 Claims, 12 Drawing Sheets

UMBRELLA MECHANISM

FIELD OF INVENTION

This invention relates to an umbrella mechanism.

SUMMARY OF INVENTION

According to the invention there is provided an umbrella mechanism comprising a central post having an upper end and a lower end;

a plurality of ribs surrounding the post that are hingedly connected to the upper end of the post, the ribs being displaceable between a collapsed condition wherein the ribs are disposed adjacent the post and an open condition wherein the ribs extend radially from the post;

a sliding hub that is slideably retained on the post;

a plurality of struts surrounding the post and having post ends that are hingedly connected to the hub and rib ends that are hingedly connected to the ribs;

at least one tensioning element that is attached to the ribs; and urging means that exerts a pulling force on the tensioning element in a direction for causing elevation of the ribs into the open condition thereof.

The umbrella mechanism may include a plurality of flexible slender tensioning elements that each extend from an operative upper end of the urging means to a distal end of a different one of the ribs, where the slender element is attached to the rib.

The urging means may be in the form of a gas spring that is disposed at the upper end of the central post and that acts between the post and the tensioning elements for exerting said pulling force on the tensioning elements.

The umbrella mechanism may include a cap that is mounted to an operative upper end of the gas spring and that defines a radially extending flange formation from which the tensioning elements extend, the flange formation being sufficiently wide so as to space the tensioning elements from the central post a sufficient distance to prevent interference between the tensioning elements and upper ends of the ribs when the ribs are in their collapsed condition.

Each strut may define a longitudinal axis along its length and the central post defines a longitudinal axis along its length, the struts each forming an angle defined between the longitudinal axes of the strut and the central post, in an optimum range between 70 and 75 degrees, when the ribs are disposed in their open condition.

The gas spring may project above the upper end of the central post in an arrangement wherein the gas spring projects progressively further above the upper end of the central post as the ribs are displaced into their open condition, thereby increasing the lever arm between the tensioning elements and the ribs, thus assisting in holding the ribs in their open condition.

The central post may comprise a post section having a lower end defining said lower end of the post and an upper end; and an extension section that has a lower end and an upper end that defines said upper end of the central post to which the ribs are hingedly connected, the extension section being mounted to the post section at an upper end region thereof in an arrangement wherein the extension section is telescopically displaceable with respect to the post section, thereby permitting lifting of the extension section with respect to the post section so as to allow lifting of the ribs clear of obstacles that may be in the way of the ribs when the ribs are displaced between their open and collapsed conditions.

The extension section may define an open-topped hollow section within which a lower end region of the gas spring is located, the extension section defining a stop formation against which a lower end of the gas spring abuts.

The post section may have a stop formation at a predetermined position along its length, that is spaced above a position that would otherwise be the lowest point of travel of the sliding hub when the ribs are in their collapsed condition, thereby causing the sliding hub to abut against the stop formation when the ribs are being displaced into their collapsed condition, in use, and the extension section to be displaced telescopically upwardly with respect to the post section, thereby lifting the ribs in the process, until the ribs are finally in their collapsed condition.

The tensioning element may be in the form of a flexible sheet element having a peripheral edge region that is attached to the ribs at their distal ends, with the urging means exerting a force on a central region of the sheet element for pushing the sheet element upwards for exerting a pulling force on the sheet element for lifting the ribs.

BRIEF DESCRIPTION OF THE DRAWINGS

Further features of the invention are now described by way of a non-limiting example of the invention, with reference to and as illustrated in the accompanying diagrammatic drawings. In the drawings.

DESCRIPTION OF PREFERRED EMBODIMENTS

Figure 1:
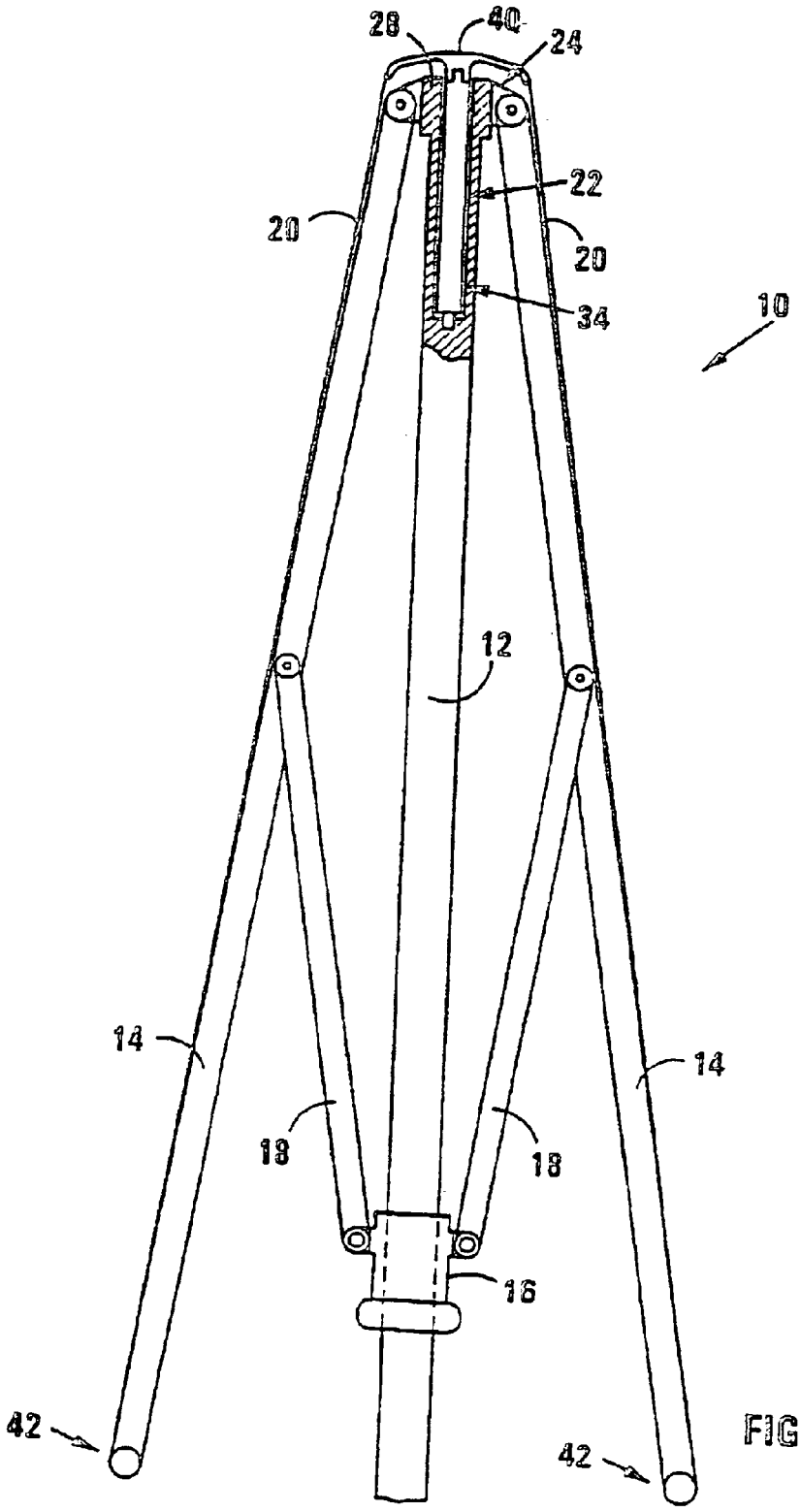
FIG. 1 shows a schematic fragmentary partly sectioned side elevation of an umbrella mechanism in accordance with the invention, in a collapsed condition.
Figure 2:
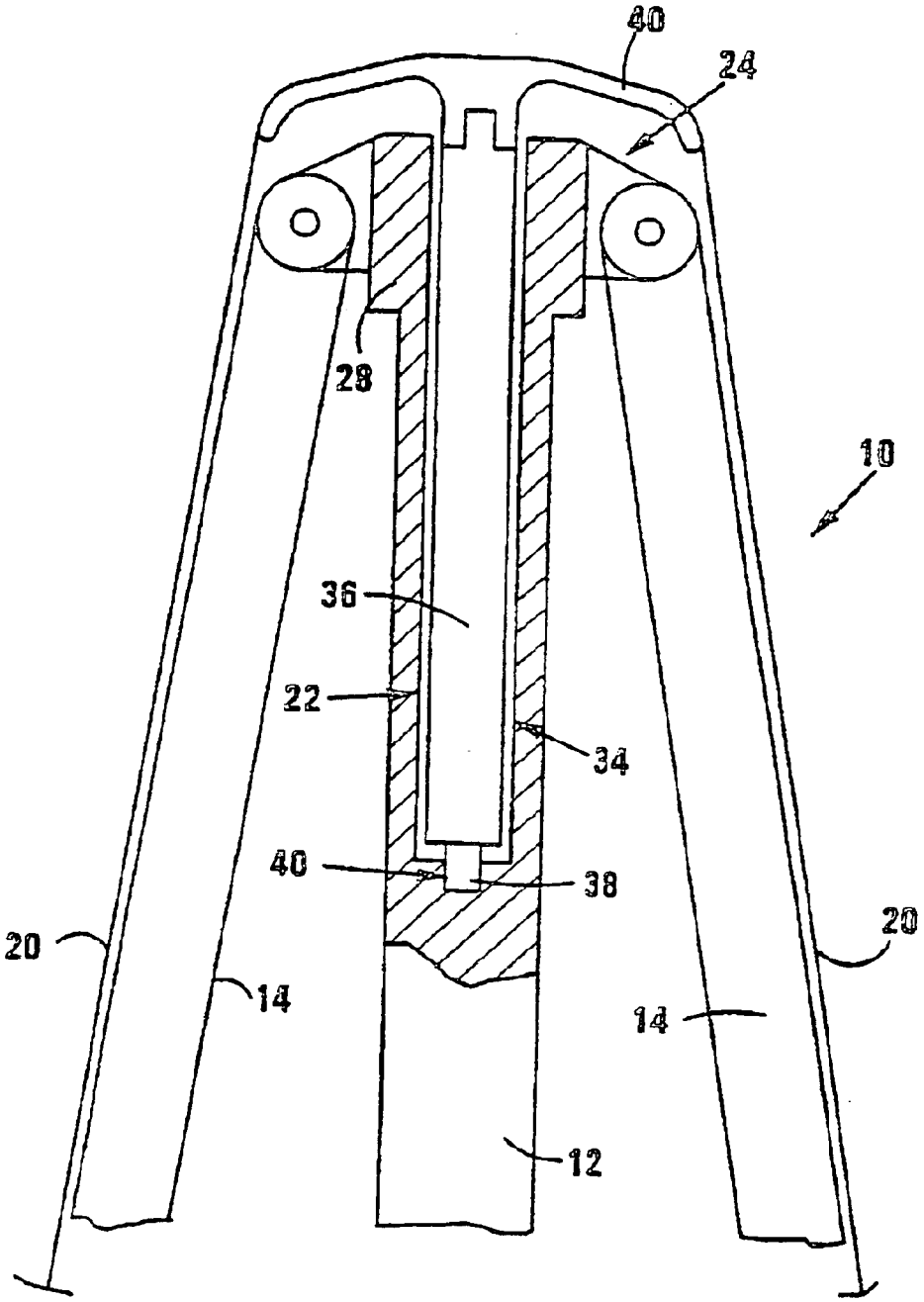
FIG. 2 shows an enlarged fragmentary partly sectioned side elevation of an upper part of the umbrella mechanism of FIG. 1.
Figure 3:
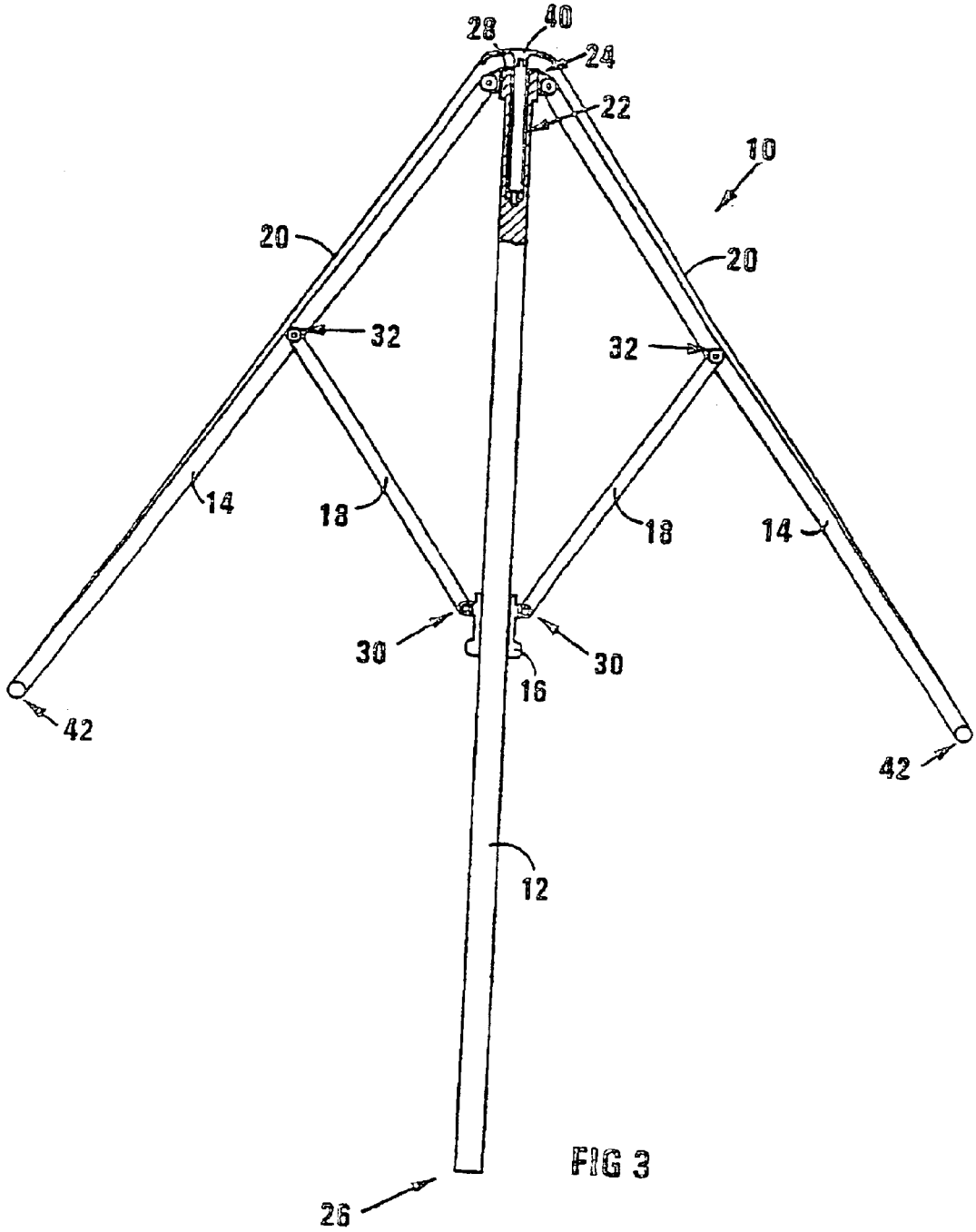
FIG. 3 shows a schematic side elevation of the umbrella mechanism of FIG. 1, in a partly open configuration.

With reference to FIGS. 1 to 6 of the drawings, an umbrella mechanism in accordance with the invention, is designated generally by the reference numeral 10. The umbrella mechanism 10 comprises a central post 12, eight ribs 14 that are hingedly connected to the central post, a sliding hub 16 that is slideably retained on the central post, eight struts 18 that each extend between a particular rib 14 and the sliding hub 16, eight tensioning elements 20 and urging means in the form of a gas spring 22 for exerting a pulling force on the tensioning elements 20.

Figure 4:
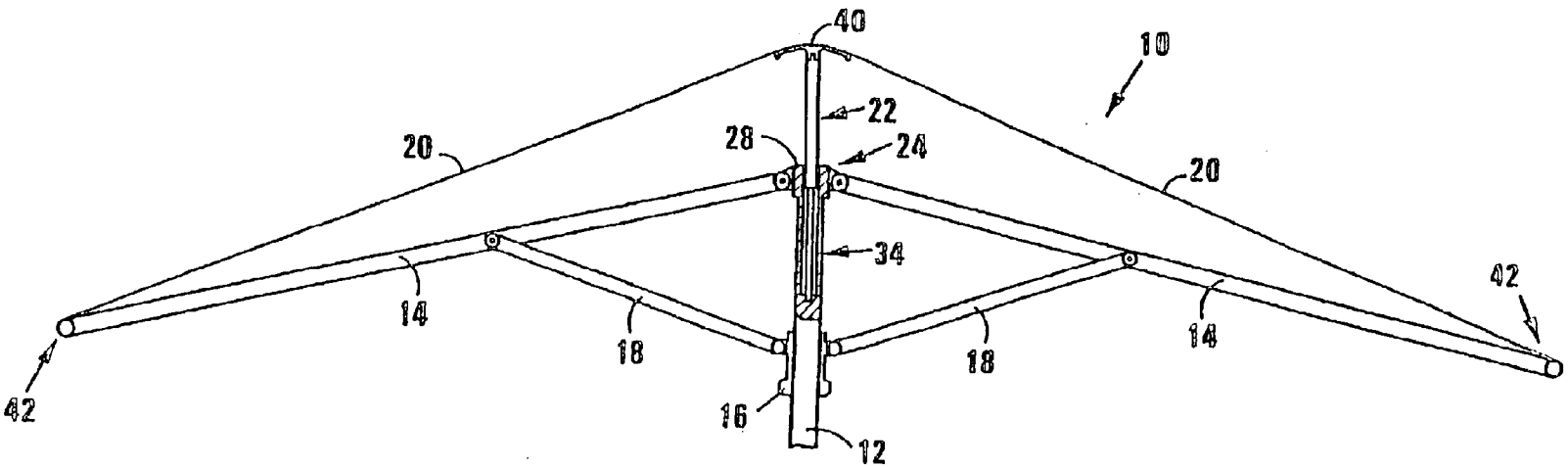
FIG. 4 shows a schematic fragmentary partly sectioned side elevation of the umbrella mechanism of FIG. 1, in an open condition thereof.
Figure 5:
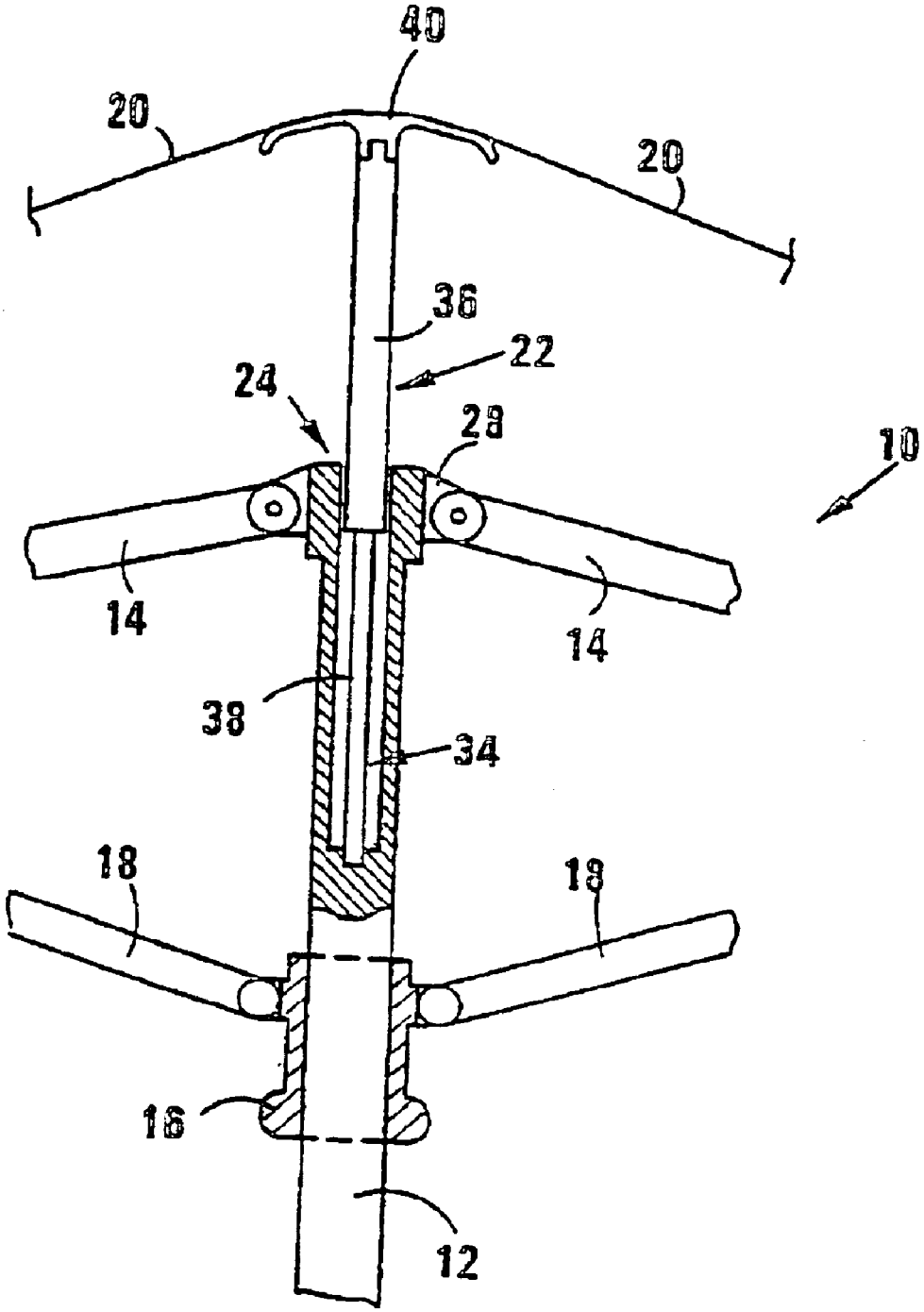
FIG. 5 shows an enlarged schematic fragmentary partly sectioned side elevation of an upper part of the umbrella mechanism of FIG. 4.

The central post 12 defines a longitudinal axis along its length and has an upper end 24 and a lower end 26 and has a fixed hub 28 at the upper end thereof. The ribs 14 surround the central post 12 and are pivotally connected to the hub 28. The ribs are pivotally displaceable between a collapsed condition (as shown in FIG. 1 of the drawings) wherein the ribs 14 are disposed adjacent the central post 12 and an open condition (as shown in FIG. 4 of the drawings) wherein the ribs extend radially from the central post 12.

Each strut 18 defines a longitudinal axis along its length and has a post end 30 that is pivotally connected to the sliding hub 16 and a rib end 32 that is pivotally connected to a different rib 14.

The upper end 24 of the central post 12 defines an open-topped cavity 34 in which the gas spring 22 is located. The gas spring 22 comprises a cylinder 36 and a piston 38 that is received in a recess 40 in the central post at a lower end of the cavity 34. The gas spring 22 is of a type which retains approximately 70% of its power at full extension thereby continuing to exert a relatively large force on the tensioning elements for holding the ribs in their open condition.

The umbrella mechanism includes a cap 40 that is mounted to an upper end of the cylinder 36 of the gas spring 22. The tensioning elements 20 are in the form of elongate cords. Each cord is secured at one end thereof to the cap 40 and at the other end thereof to a distal end 42 of the different rib 14.

The cap 40 defines a radially extending flange forming an overhang that is wider than the distance between outer edges of the fixed hub 28 and the upper ends of the ribs connected thereto, thereby ensuring that the tensioning elements 20 are spaced from the hub 28 and a upper end of the ribs a distance sufficient to prevent interference between the tensioning elements and the hub 28 and upper ends of the ribs. Interference between the tensioning elements and the hub 28 and/or upper ends of the ribs will bring undesirable friction forces into play. This is avoided by the configuration of the cap 40.

Figure 6:
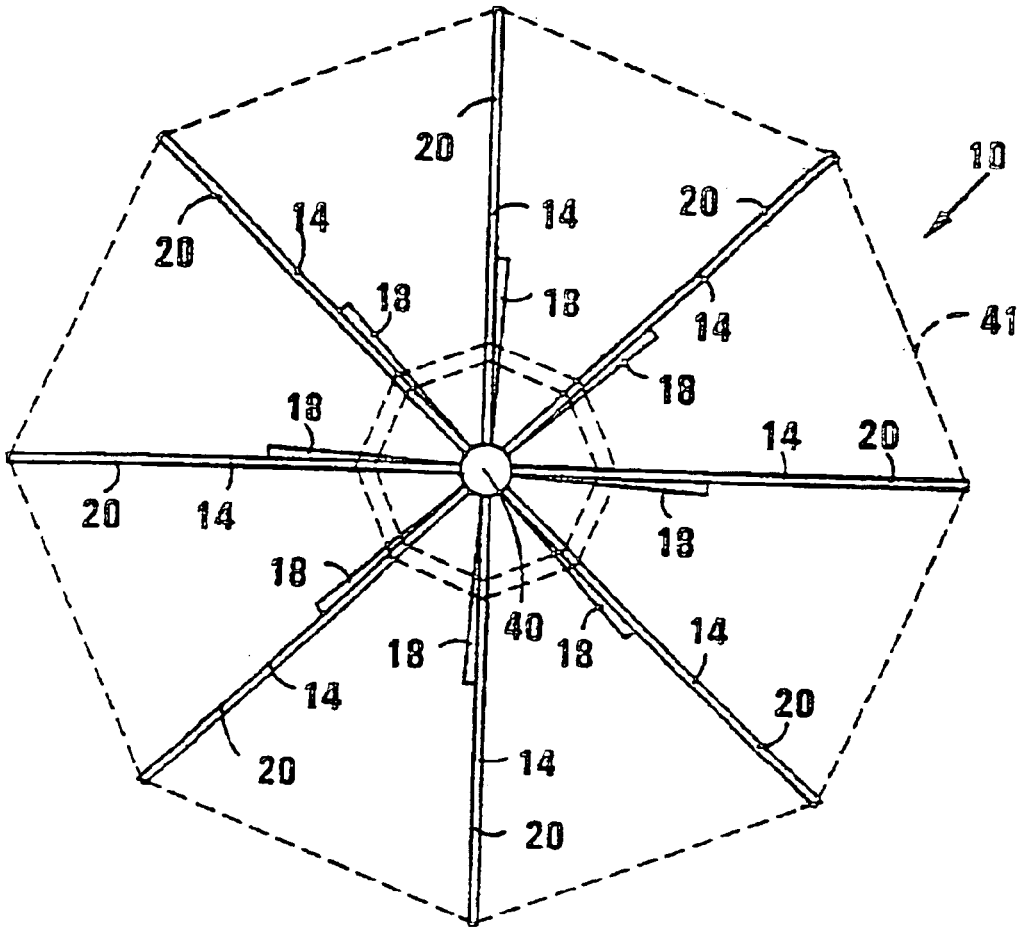
FIG. 6 shows a schematic top plan view of the umbrella mechanism of FIG. 1.
Figure 7:
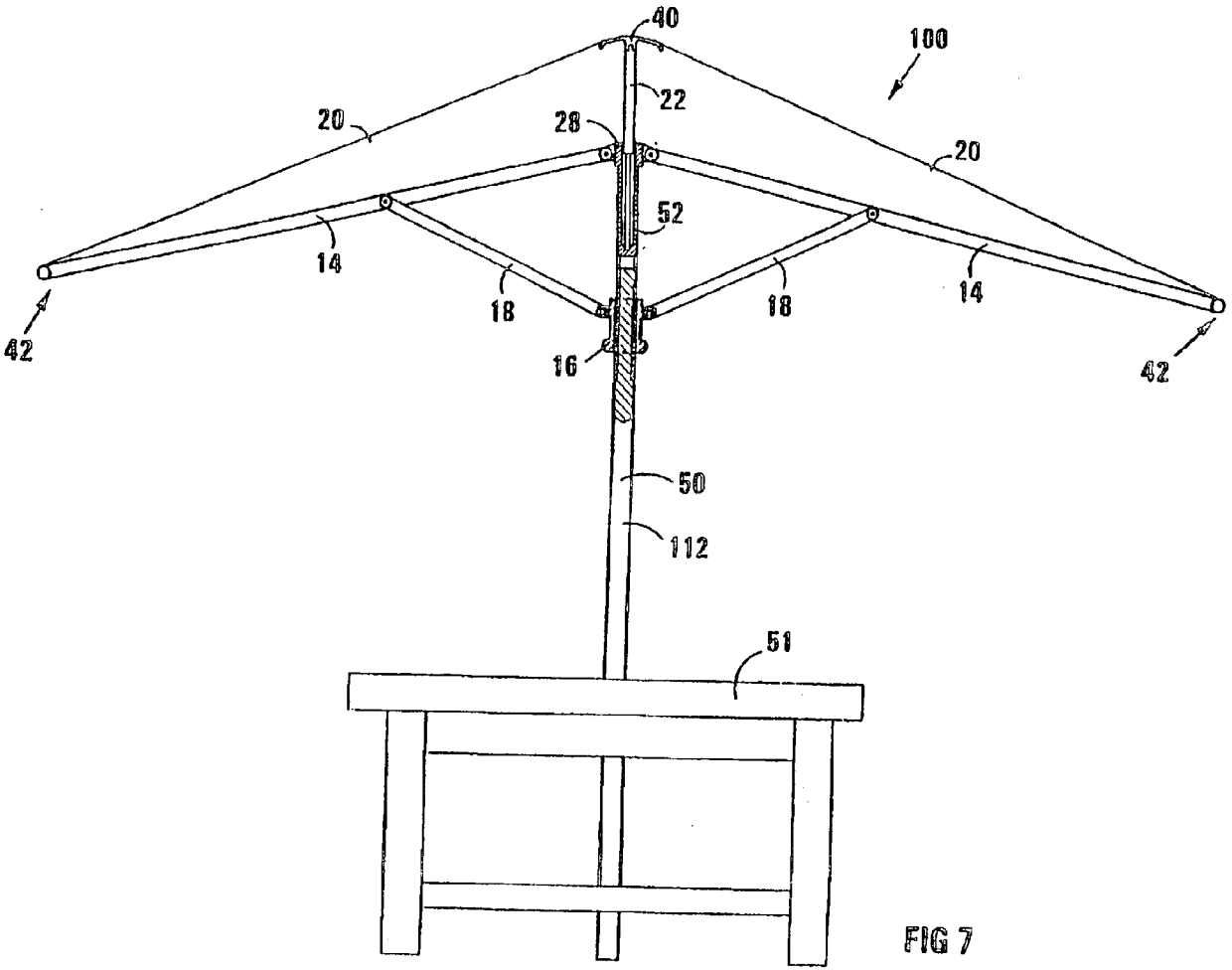
FIG. 7 shows a schematic partly sectioned side elevation of another embodiment of an umbrella mechanism in an open condition thereof, mounted to a table.
Figure 8:
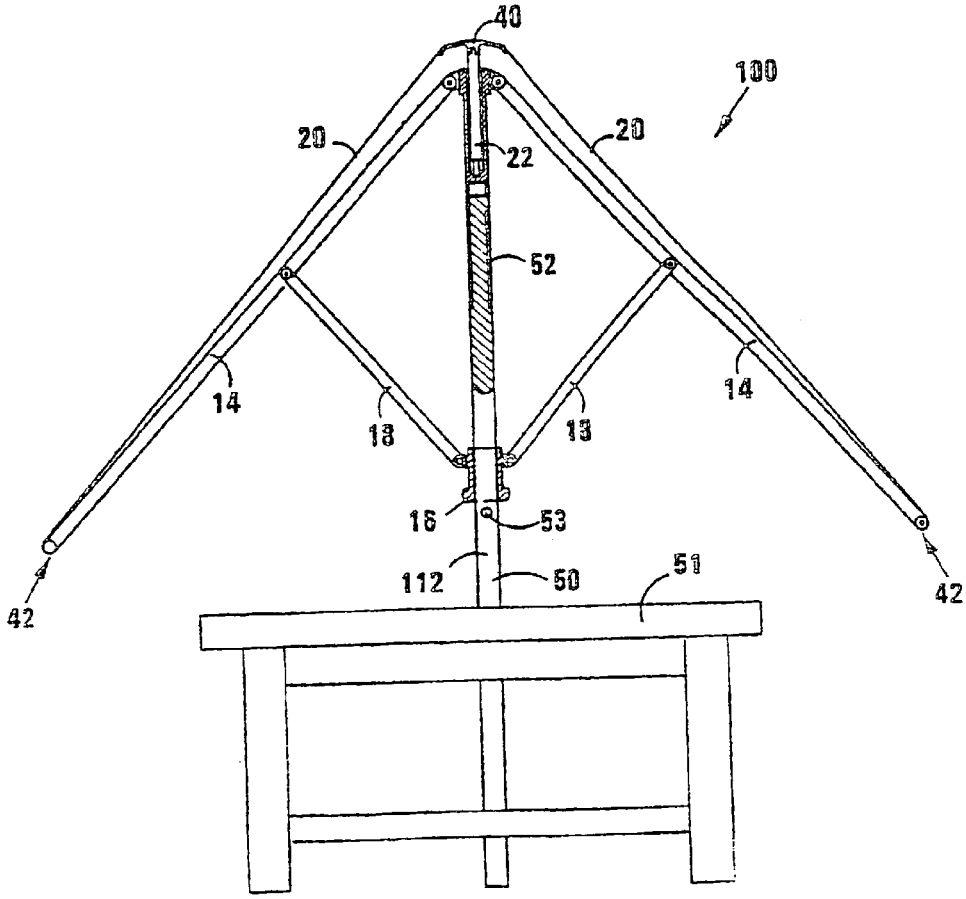
FIG. 8 shows a schematic partly sectioned side elevation of the umbrella mechanism of FIG. 7 in a partly open condition thereof.

With reference to FIG. 6 of the drawings, a canopy 41 is attached to the ribs of the umbrella mechanism at their distal ends thereby forming an umbrella.

In use, the gas spring 22 exerts an upward pulling force on the tensioning elements 10 thereby causing lifting of the ribs 14 into their open condition. The Applicant has found that the umbrella mechanism in accordance with the invention, provides a greatly improved mechanical advantage for assisting in opening the umbrella. By selecting a gas spring to match the size of the umbrella, the ribs 14 can be displaced into their open condition by merely exerting finger pressure on the sliding hub 16. When the ribs 14 are in their open condition, each strut 18 forms an angle defined between the longitudinal axes of the strut and the central post, in an optimum range between 70 and 75 degrees. The maximum extension of the gas spring and the lengths of the tensioning element are selected to provide the abovementioned optimum angle between the struts and the central post. Beyond an angle of 75 degrees, excessive force will be required to lift the ribs 14, while at an angle of less than 70 degrees, the sliding hub will tend to slide down the post 12, collapsing the ribs, when a relatively small downward force is applied to the hub and/or the ribs.

At maximum extension, the gas spring 22 still exerts a relatively large force on the ribs, thereby obviating the need for latching the sliding hub when the ribs are in their open condition. In addition, as the ribs are displaced into their open condition, the lever arm between the tensioning elements and the ribs 14, increases, thus tending to hold the ribs in their open condition.

With reference to FIGS. 7 to 12 of the drawings, another embodiment of an umbrella mechanism in accordance with the invention, is designated generally by the reference numeral 100. The umbrella mechanism 100 is similar to the umbrella mechanism 10 and the same and/or similar features of the umbrella mechanism 100 to those of the umbrella mechanism 10, are designated by the same and/or similar reference numerals in the drawings. The umbrella mechanism 100 is essentially the same as the umbrella mechanism 10 with the difference being that the umbrella mechanism 100 includes a central post 112 having a post section 50 and extension section 52 that is mounted to an operative upper end of the post section 50 in an arrangement wherein it is telescopically displaceable with respect to the post section 50.

The extension section 52 defines an open-topped cavity 134 in which the gas spring 22 is located. The extension section 52 defines a stop formation 54 at a lower end of the cavity 134, against which a lower end of the gas spring 22 abuts. The extension section 52 has a lower end region 56 that is hollow and within which an upper end region of the post section 50 is slideably received. The post section 50 defines a rebate 58 which provides a stop against which a lower end of the extension section 52 abuts when the extension section 52 is in a retracted condition. The post section 50 defines a key 60 at its upper end which is slideably received in a key-way 62 defined in the extension section 52, thereby preventing rotation of the extension section 52 relative to the post section 50.

The post 112 defines an aperture a predetermined distance along its length, in which a stop pin 53 is received, thereby providing a stop against which the sliding hub 16 abuts at its lowest point of travel.

Figure 9:
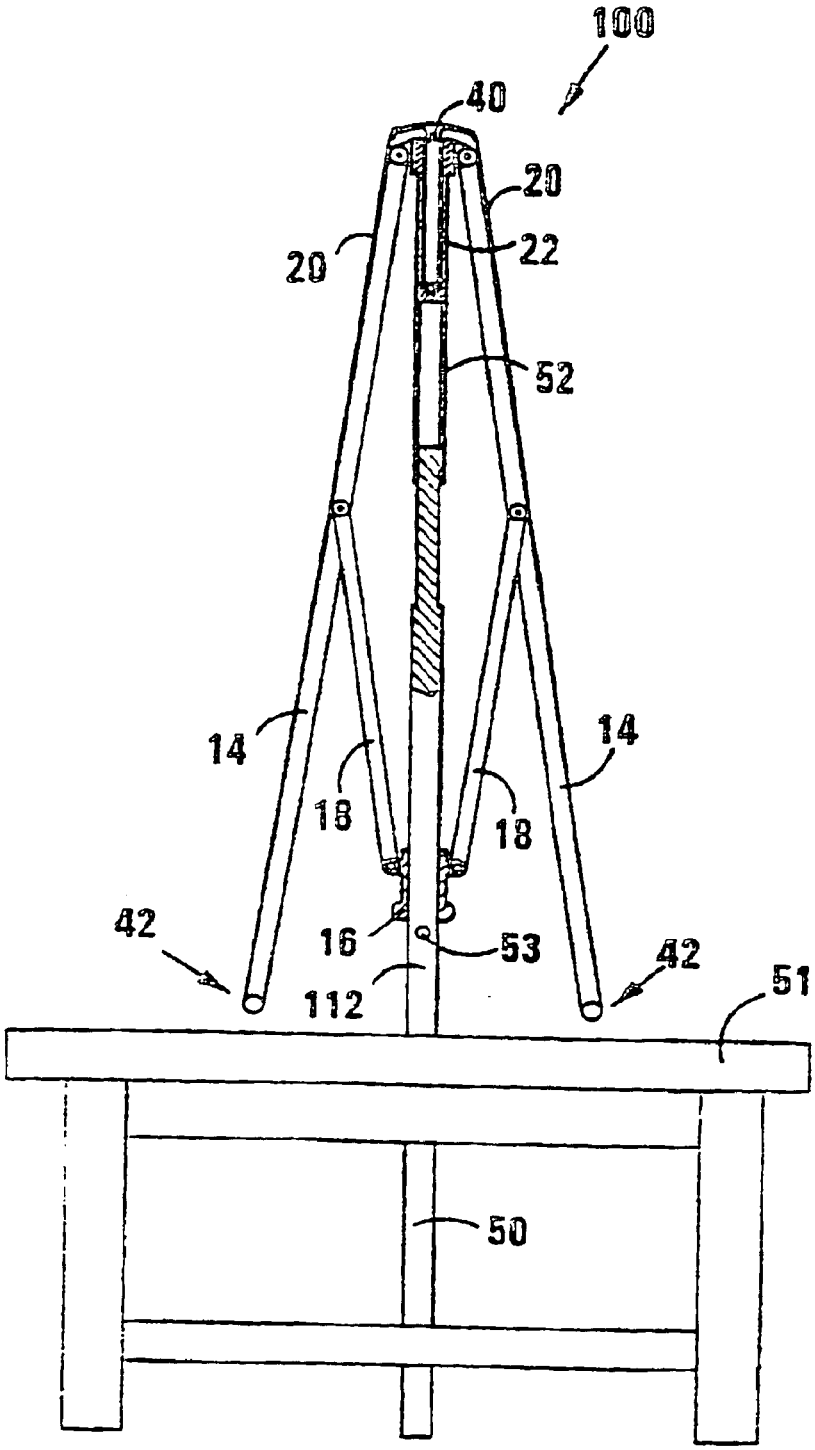
FIG. 9 shows a schematic partly sectioned side elevation of the umbrella mechanism of FIG. 7 in a collapsad condition thereof.
Figure 10:
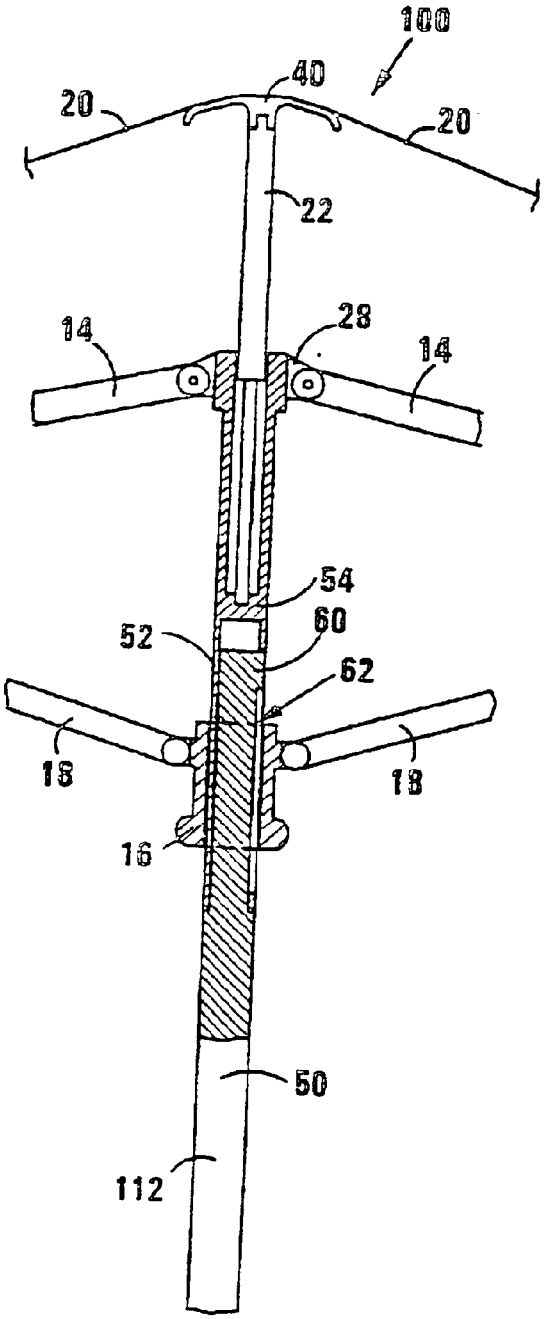
FIG. 10 shows an enlarged schematic fragmentary partly sectioned side elevation of an upper part of the umbrella mechanism illustrated in FIG. 7 of the drawings.
Figure 11:
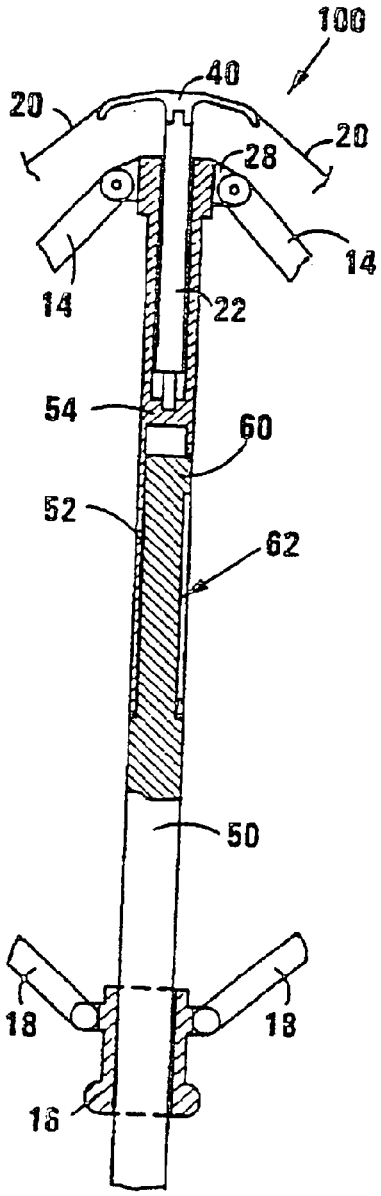
FIG. 11 shows an enlarged schematic fragmentary side elevation of an upper part of the umbrella mechanism illustrated in FIG. 8 of the drawings.
Figure 12:
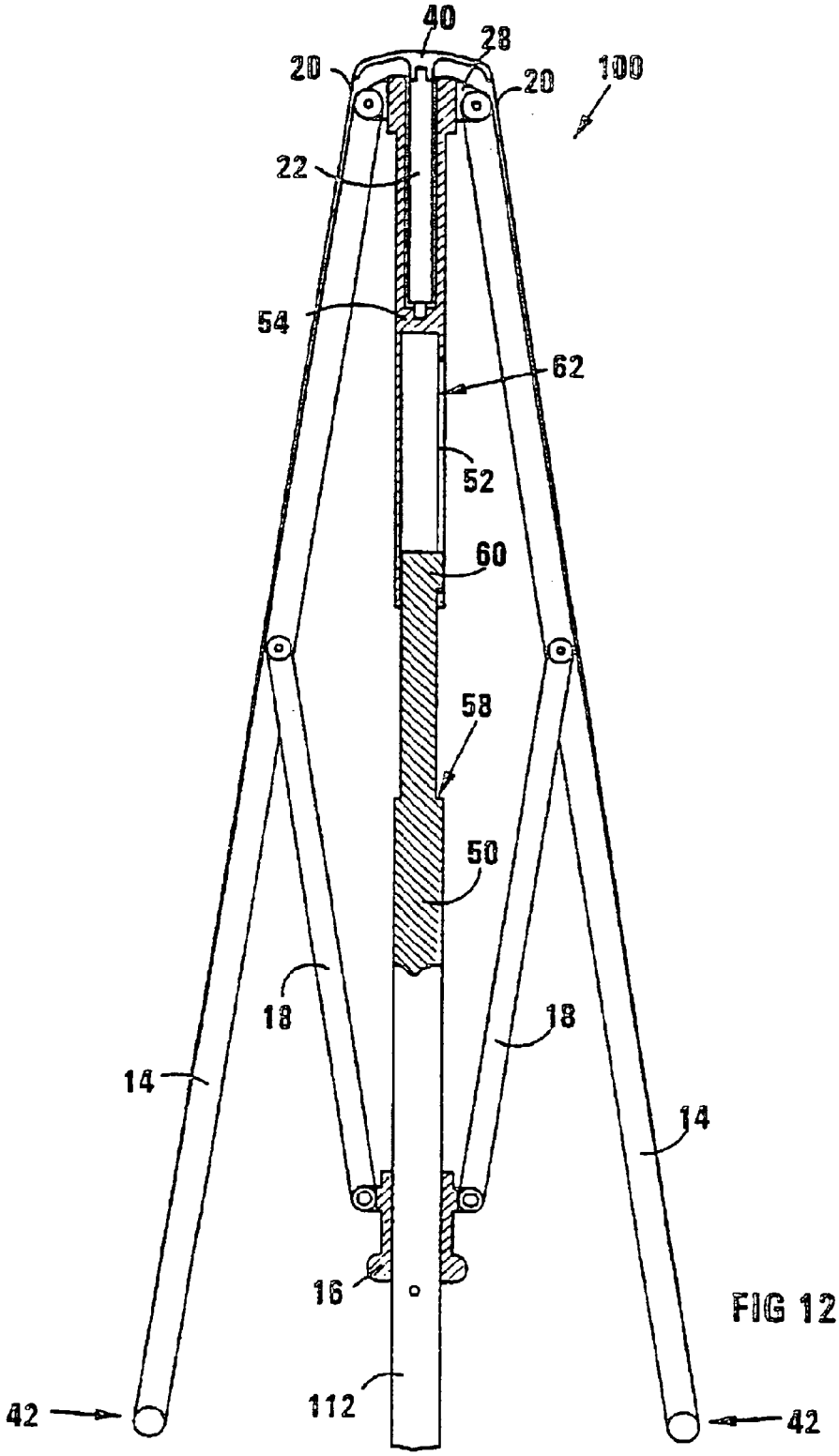
FIG. 12 shows an enlarged schematic fragmentary side elevation of the umbrella mechanism illustrated in FIG. 9.

In use, the extension section 52 is telescopically displaceable with respect of the post section 50 between a ratracted condition (as is illustrated in FIGS. 7, 8 10 and 11) and an extended condition (as is illustrated in FIGS. 9 and 12). Thus, in instances where it is necessary to lift the distal ends 42 of the ribs 14 clear of obstacles such as a table 51 to which the umbrella mechanism is mounted and that may be in the way of the ribs when the ribs are displaced into their collapsed condition, the extension section 52 is lifted with respect to the post section 50 thereby permitting the distal ends 42 of the ribs 14 to be lifted clear of the table. When collapsing the ribs 14, the sliding hub 16 slides down the post section 50 until it encounters the stop pin 53. The gas spring 22 continues to exert a force on the tensioning element 20 and as such, the extension section 52 will then commence lifting until it reaches maximum extension.

The above features allow the umbrella mechanism to be used in a number of applications which would not be possible for umbrellas not having this feature. In certain instances, it may be desirable to have the canopy at a relatively low height above, for example, a table. The umbrella mechanism 100 permits the canopy to be disposed relatively low above a table, while still permitting pivoting of the ribs between their open and closed conditions. Displacement of the extension section 52 relative to the post section 50 thus obviates the need to lift the central post of the umbrella mechanism so that the distal ends of the ribs clear the table top. In many cases, lower ends of the central post of umbrellas are fixed to the ground or to ballast, thereby rendering it impossible to lift the umbrella. The advantages of the umbrella mechanism 100 in the abovementioned situations is thus clearly evident.

Figure 13:
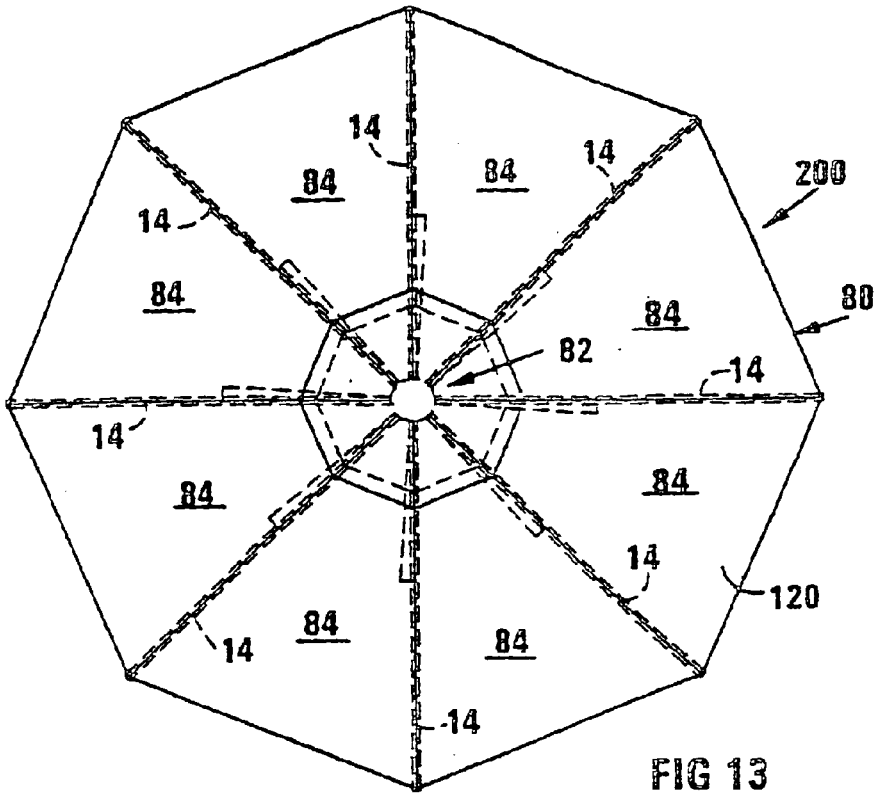
FIG. 13 shows a schematic top plan view of yet another embodiment of an umbrella mechanism in accordance with the invention.
Figure 14:
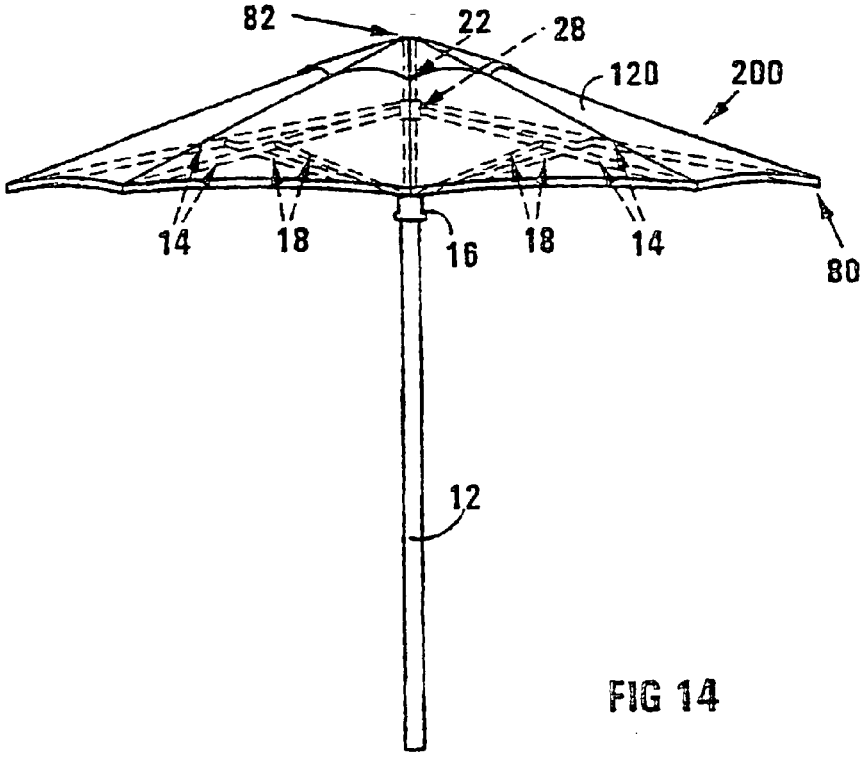
FIG. 14 shows a schematic side elevation of the umbrella mechanism of FIG. 13.

With reference to FIGS. 13 and 14 of the invention, yet another embodiment of an umbrella mechanism in accordance with the invention, is designated generally by the reference numeral 200. Features of the umbrella mechanism 200 that are the same and/or similar to those of the umbrella mechanism 10, are designated by the same and/or similar reference numerals. The umbrella mechanism 200 is the same as the umbrella mechanism 10, with the only difference being that the tensioning elements are replaced by a single tensioning element in the form of a flexible sheet element 120 having a peripheral edge region 18 that is attached to the ribs 14 at their distal ends, in an arrangement wherein the gas spring 22 exerts a force on an underside of a central region 82 of the sheet element for pushing the sheet element upwards thereby exerting a pulling force on the sheet element for lifting the distal ends of the ribs into their open conditions. The sheet element 120 comprises eight triangular panel elements 84 that are stitched together along seams that are disposed above the ribs 14. The seams are reinforced with additional strips of fabric material so as to provide addition strength in these areas. The central region against which the gas spring 22 exerts a force, is also reinforced with additional fabric elements.

What is claimed is:

1. An umbrella mechanism comprising a central post having an upper end and a lower end;

a plurality of ribs surrounding the post that are hingedly connected to the upper end of the post, the ribs being displaceable between a collapsed condition wherein the ribs are disposed adjacent the post and an open condition wherein the ribs extend radially from the post;

a sliding hub that is slideably retained on the post;

a plurality of struts surrounding the post and having post ends that are hingedly connected to the hub and rib ends that are hingedly connected to the ribs;

urging means that is disposed at the upper end of the central post; and at least one flexible tensioning element characterized in that the tensioning element extends between an upper end of the urging means and a distal end of one of the ribs where the tensioning element is attached to the rib, the urging means exerting a pulling force on the tensioning element for lifting the ribs into the open condition thereof.

2. An umbrella mechanism as claimed in claim 1, characterized in that the umbrella mechanism includes a plurality of flexible slender tensioning elements that each extend from an operative upper end of the urging means to a distal end of a different one of the ribs, where the slender element is attached to the rib.

3. An umbrella mechanism as claimed in claim 2, characterized in that the urging means is in the form of a gas spring that is disposed at the upper end of the central post and that acts between the post and the tensioning elements for exerting said pulling force on the tensioning elements.

4. An umbrella mechanism as claimed in claim 3, characterized in that the umbrella mechanism includes a cap that is mounted to an upper end of the gas spring and that defines a radially extending flange formation from which the tensioning elements extend, the flange formation being sufficiently wide so as to space the tensioning elements from the central post a sufficient distance to prevent interference between the tensioning elements and upper ends of the ribs when the ribs are in their collapsed condition.

5. An umbrella mechanism as claimed in claim 3, characterized in that the gas spring projects above the upper end of the central post in an arrangement wherein the gas spring projects progressively further above the upper end of the central post as the ribs are displaced into their open condition, thereby increasing the lever arm between the tensioning elements and the ribs, thus assisting in holding the ribs in their open condition.

6. An umbrella mechanism as claimed in claim 3, characterized in that the central post comprises a post section having a lower end defining said lower end of the post and an upper end; and an extension section that has a lower end and an upper end that defines said upper end of the central post to which the ribs are hingedly connected, the extension section being mounted to the post section at an upper end region thereof in an arrangement wherein the extension section is telescopically displaceable with respect to the post section, thereby permitting lifting of the extension section with respect to the post section so as to allow lifting of the ribs clear of obstacles that may be in the way of the ribs when the ribs are displaced between their open and collapsed conditions.

7. An umbrella mechanism as claimed in claim 6, characterized in that the extension section defines an open-topped hollow section within which a lower end region of the gas spring is located, the extension section defining a stop formation against which a lower end of the gas spring abuts.

8. An umbrella mechanism as claimed in claim 6 or claim 7, characterized in that the post section has a stop formation at a predetermined position along its length, that is spaced above a position that would otherwise be the lowest point of travel of the sliding hub when the ribs are in their collapsed condition, thereby causing the sliding hub to abut against the stop formation when the ribs are being displaced into their collapsed condition, in use, and the extension section to be displaced telescopically upwardly with respect to the post section, thereby lifting the ribs in the process, until the ribs are finally in their collapsed condition.

9. An umbrella mechanism as claimed in claim 1, characterized in that each strut defines a longitudinal axis along its length and the central post defines a longitudinal axis along its length, the struts each forming an angle defined between the longitudinal axes of the strut and the central post, in an optimum range between 70 and 75 degrees, when the ribs are disposed in their open condition.

10. An umbrella mechanism as claimed in claim 1, characterized in that the tensioning element is in the form of a flexible sheet element having a peripheral edge region that is attached to the rib at its distal end, with the urging means exerting a force on a central region of the sheet element for pushing the sheet element upwards for exerting a pulling force on the sheet element for lifting the ribs.

11. An umbrella mechanism comprising a central post having an upper end and a lower end;

a plurality of ribs surrounding the post that are hingedly connected to the upper end of the post, the ribs being displaceable between a collapsed condition wherein the ribs are disposed adjacent the post and an open condition wherein the ribs extend radially from the post;

a sliding hub that is slideably retained on the post;

a plurality of struts surrounding the post and having post ends that are hingedly connected to the hub and rib ends that are hingedly connected to the ribs;

urging means that is disposed at the upper end of the central post; and at least one flexible tensioning element characterized in that the tensioning element extends between an upper end of the urging means and a distal end of one of the ribs where the tensioning element is attached to the rib, the urging means exerting a pulling force on the tensioning element for lifting the ribs into the open condition thereof, and wherein the tensioning element is in the form of a flexible sheet element having a peripheral edge region that is attached to the rib at its distal end, with the urging means exerting a force on a central region of the sheet element for pushing the sheet element upwards for exerting a pulling force on the sheet element for lifting the ribs.

* * * * *

UNITED STATES PATENT AND TRADEMARK OFFICE

CERTIFICATE OF CORRECTION

PATENT NO. : 6,810,893 B1
DATED : November 2, 2004
INVENTOR(S) : Nevin

It is certified that error appears in the above-identified patent and that said Letters Patent is hereby corrected as shown below:

Title page,
Item [73], Assignee, "Powerbrella Clare Corporation." should read
-- Powerbrella Close Corporation --

Signed and Sealed this

Seventh Day of June, 2005

JON W. DUDAS
*Director of the United States Patent and Trademark Office*